US011851151B2

(12) United States Patent
Watanabe

(10) Patent No.: US 11,851,151 B2
(45) Date of Patent: Dec. 26, 2023

(54) OUTBOARD MOTOR AND MARINE PROPULSION SYSTEM

(71) Applicant: YAMAHA HATSUDOKI KABUSHIKI KAISHA, Iwata (JP)

(72) Inventor: Masahisa Watanabe, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 98 days.

(21) Appl. No.: 17/475,384

(22) Filed: Sep. 15, 2021

(65) Prior Publication Data

US 2022/0081092 A1 Mar. 17, 2022

(30) Foreign Application Priority Data

Sep. 16, 2020 (JP) ..... 2020-155612

(51) Int. Cl.
*B63H 21/21* (2006.01)
*B63H 20/14* (2006.01)
(Continued)

(52) U.S. Cl.
CPC ..... *B63H 21/21* (2013.01); *B63H 20/14* (2013.01); *B63H 20/20* (2013.01); *B63H 21/14* (2013.01);
(Continued)

(58) Field of Classification Search
CPC ..... F02B 61/04; F02B 61/045; F02B 63/042; B63H 20/14; B63H 20/20; B63H 21/20;
(Continued)

(56) References Cited

U.S. PATENT DOCUMENTS 4,726,798 A * 2/1988 Davis ..... F02P 11/025 440/86
4,732,055 A * 3/1988 Tateno ..... F16H 59/54 701/56
(Continued)

FOREIGN PATENT DOCUMENTS

EP 3 613 663 A1 2/2020
JP 4201234 B2 12/2008
(Continued)

OTHER PUBLICATIONS

Official Communication issued in corresponding European Patent Application No. 21196861.5, dated Feb. 14, 2022.

*Primary Examiner* — John M Zaleskas
(74) *Attorney, Agent, or Firm* — Keating & Bennett, LLP

(57) ABSTRACT

An outboard motor includes an engine, a generator to generate power by driving of the engine, a driving force transmitter to transmit a driving force from the engine, a propeller shaft to rotate by being switched from a neutral state in which a clutch is disconnected from the driving force transmitter of the engine at idle to a non-neutral state in which the clutch is connected to the driving force transmitter, and a controller configured or programmed to perform a control to reduce a rotation speed of the engine by regeneration of the generator based on a user's switching operation on a shift operator to switch the outboard motor from the neutral state to the non-neutral state, and then connect the clutch to the driving force transmitter while rotating the engine.

18 Claims, 4 Drawing Sheets

(51) Int. Cl.

| | |
|---|---|
| ***B63H 21/14*** | (2006.01) |
| ***B63H 23/34*** | (2006.01) |
| ***F02B 61/04*** | (2006.01) |
| ***F02B 63/04*** | (2006.01) |
| ***F02D 29/06*** | (2006.01) |
| ***B63H 20/20*** | (2006.01) |
| ***B63H 23/30*** | (2006.01) |

(52) U.S. Cl.
CPC ..... *B63H 21/213* (2013.01); *B63H 23/30* (2013.01); *B63H 23/34* (2013.01); *F02B 61/045* (2013.01); *F02B 63/042* (2013.01); *F02D 29/06* (2013.01); *F02D 2200/101* (2013.01); *F02D 2200/50* (2013.01)

(58) Field of Classification Search
CPC ..... B63H 21/21; B63H 21/213; B63H 23/30; F02D 2200/101; F02D 2200/50; F02D 29/06
See application file for complete search history.

(56) References Cited

U.S. PATENT DOCUMENTS 4,770,142 A * 9/1988 Hayashi ..... F02P 11/02 123/632
4,817,466 A * 4/1989 Kawamura ..... B63H 21/213 477/107
4,966,115 A * 10/1990 Ito ..... F02P 5/1508 477/109
4,986,776 A * 1/1991 Hensel ..... F02P 5/1504 477/111
5,403,246 A * 4/1995 Umemoto ..... F02B 61/045 477/109
5,422,625 A * 6/1995 Sakaemura ..... B60Q 1/54 340/459
5,531,070 A * 7/1996 Berger ..... F02B 77/08 60/431
5,827,150 A * 10/1998 Mukumoto ..... F02D 29/02 477/109
6,102,755 A * 8/2000 Hoshiba ..... B63H 21/213 440/86
6,396,161 B1 * 5/2002 Crecelius ..... B63H 21/21 322/1
6,470,852 B1 * 10/2002 Kanno ..... F02D 41/16 123/339.11
6,699,081 B1 * 3/2004 Divljakovic ..... F02N 15/067 440/85
6,942,530 B1 * 9/2005 Hall ..... F02D 31/002 477/101
8,454,402 B1 * 6/2013 Arbuckle ..... B63H 21/21 440/86
8,808,139 B1 * 8/2014 Arbuckle ..... B60W 10/02 477/5
9,043,058 B1 * 5/2015 Camp ..... B63H 21/21 701/21
10,059,417 B1 * 8/2018 Hilbert ..... B63H 21/213
10,155,577 B1 * 12/2018 Van Buren ..... B63H 21/21
2006/0135314 A1 * 6/2006 Shomura ..... B63H 20/20 477/109
2007/0270054 A1 * 11/2007 Ito ..... F02D 11/02 440/75
2008/0124989 A1 * 5/2008 Sturdy ..... B63H 21/22 440/75
2010/0059300 A1 * 3/2010 Brown ..... B60W 10/08 74/504
2010/0248561 A1 * 9/2010 Daikoku ..... B63J 3/02 903/905
2011/0195618 A1 * 8/2011 Arbuckle ..... B63H 21/20 440/3
2012/0231684 A1 * 9/2012 Kuriyagawa ..... B63H 21/213 440/86
2012/0295498 A1 * 11/2012 Kuriyagawa ..... B63H 21/21 440/1
2015/0112521 A1 * 4/2015 Kirchhoff ..... F02B 61/045 701/21
2017/0210385 A1 * 7/2017 Boemcke ..... F02D 41/0205
2017/0349256 A1 * 12/2017 Nakamura ..... B63H 23/34
2019/0047674 A1 * 2/2019 Nakamura ..... B63H 23/30
2019/0300136 A1 * 10/2019 Nakamura ..... B63H 23/08
2020/0062361 A1 * 2/2020 Nakamura ..... B63H 21/21
2020/0300191 A1 * 9/2020 Inoue ..... B63H 20/10
2021/0284311 A1 * 9/2021 Ikegaya ..... B63H 21/20
2022/0081089 A1 * 3/2022 Watanabe ..... B63H 20/32
2022/0081090 A1 * 3/2022 Watanabe ..... H02J 7/00304

FOREIGN PATENT DOCUMENTS

JP 2012-254691 A 12/2012
JP 2012254691 A * 12/2012 ..... B63H 20/14

* cited by examiner

NEUTRAL STATE

FORWARD MOVEMENT STATE

REVERSE MOVEMENT STATE

OUTBOARD MOTOR AND MARINE PROPULSION SYSTEM

CROSS REFERENCE TO RELATED APPLICATIONS

This application claims the benefit of priority to Japanese Patent Application No. 2020-155612 filed on Sep. 16, 2020. The entire contents of this application are hereby incorporated herein by reference.

BACKGROUND OF THE INVENTION

1. Field of the Invention

The present invention relates to an outboard motor and a marine propulsion system.

2. Description of the Related Art

An outboard motor and a marine propulsion system each including a controller configured or programmed to perform a control to reduce a shift shock are known in general. Such an outboard motor and a marine propulsion system are disclosed in Japanese Patent No. 4201234, for example.

Japanese Patent No. 4201234 discloses an outboard motor including a dog clutch, forward and reverse gears, and a controller configured or programmed to perform a control to reduce shift shocks generated when the dog clutch meshes with the forward gear or reverse gear (at the time of shift-in). The forward and reverse gears are constantly rotating when an engine is driven, including in a neutral state. The dog clutch is provided on a propeller shaft and is stopped in the neutral state.

The controller reduces the rotation speed of the engine (the forward gear or reverse gear) in the neutral state in advance such that the rotation speed of the engine is closer to the rotation speed (0 rpm) of the dog clutch that has stopped rotating so as to reduce shift shocks at the time of shift-in. In such a case, the controller reduces the rotation speed of the engine by a retarding control to temporarily retard the ignition timing of the engine or a misfire control to temporarily stop the ignition of the engine.

In the outboard motor disclosed in Japanese Patent No. 4201234, the retarding control or misfire control is performed in order to maintain the rotation speed of the engine low at the time of shift-in, but in order to further reduce shift shocks, it is required to reduce the rotation speed of the engine at the time of shift-in.

SUMMARY OF THE INVENTION

Preferred embodiments of the present invention provide outboard motors and marine propulsion systems that each effectively reduce the rotation speeds of engines at the time of shift-in to reduce shift shocks.

An outboard motor according to a preferred embodiment of the present invention includes an engine including a crankshaft, a generator connected to the crankshaft to generate power by driving of the engine, a driving force transmitter connected to the crankshaft to transmit a driving force from the engine, a propeller shaft including a clutch and to rotate by being switched from a neutral state in which the clutch is disconnected from the driving force transmitter of the engine at idle to a non-neutral state in which the clutch is connected to the driving force transmitter, and a controller configured or programmed to perform a control to reduce a rotation speed of the engine by regeneration of the generator based on a user's switching operation on a shift operator to switch the outboard motor from the neutral state to the non-neutral state, and then connect the clutch to the driving force transmitter while rotating the engine.

An outboard motor according to a preferred embodiment of the present invention includes the controller configured or programmed to perform a control to reduce the rotation speed of the engine by the regeneration of the generator based on the user's switching operation on the shift operator to switch the outboard motor from the neutral state to the non-neutral state, and then connect the clutch to the driving force transmitter while rotating the engine. Accordingly, unlike a conventional case in which a retarding control or misfire control is performed, a brake is directly applied to the crankshaft by the generation of the generator, and thus the rotation speed of the engine is effectively reduced. Therefore, the rotation speed of the engine is effectively reduced at the time of shift-in in order to reduce shift shocks. Furthermore, the rotation speed of the engine is reduced in a shorter time as compared with the conventional case in which a retarding control or misfire control is performed.

An outboard motor according to a preferred embodiment of the present invention preferably further includes a rotation speed sensor to detect the rotation speed of the engine, and the controller is preferably configured or programmed to stop the control to reduce the rotation speed of the engine by the regeneration of the generator based on the rotation speed sensor detecting that the rotation speed of the engine has become equal to or lower than a first rotation speed. Accordingly, when the rotation speed of the engine becomes equal to or lower than the first rotation speed, the control to reduce the rotation speed of the engine by the regeneration of the generator is stopped, and thus stopping of the engine (occurrence of engine stall) due to an excessive reduction in the rotation speed of the engine is significantly reduced or prevented.

In such a case, the generator preferably drives the engine by power running in addition to regeneration, and the controller is preferably configured or programmed to perform a control to maintain the rotation speed of the engine at the first rotation speed or higher by the power running of the generator until the outboard motor is switched from the neutral state to the non-neutral state by the clutch based on the rotation speed sensor detecting that the rotation speed of the engine has become equal to or lower than the first rotation speed. Accordingly, the power running is performed from the time at which the rotation speed of the engine becomes equal to or lower than the first rotation speed to the shift-in (the time at which the outboard motor is switched from the neutral state to the non-neutral state by the clutch), and thus the shift shocks are reduced by maintaining the rotation speed of the engine relatively low while stopping of the engine due to an excessive reduction in the rotation speed of the engine is significantly reduced or prevented.

In an outboard motor that reduces the rotation speed of the engine by the regeneration based on the rotation speed of the engine becoming equal to or lower than the first rotation speed, the first rotation speed is preferably about 300 rpm or less. Accordingly, when the rotation speed of the engine becomes equal to or lower than about 300 rpm or less at which the possibility that engine stall occurs (the engine is stopped) is increased, the control to reduce the rotation speed of the engine by the regeneration is stopped.

An outboard motor including the generator further includes a shift sensor to detect a shift position of the clutch, and the controller is preferably configured or programmed to perform a control to increase the rotation speed of the engine by the power running of the generator when it is determined that the outboard motor has been switched from the neutral state to the non-neutral state based on the shift position of the clutch detected by the shift sensor. Accordingly, even when rotational resistance is applied from the propeller shaft to the engine via the driving force transmitter after shift-in, the rotation speed of the engine is increased by the power running, and thus stopping of the engine due to shift-in is significantly reduced or prevented.

In such a case, the controller is preferably configured or programmed to stop the control to reduce the rotation speed of the engine by the regeneration of the generator when the regeneration of the generator continues and the controller determines that the outboard motor has been switched from the neutral state to the non-neutral state based on the shift position of the clutch detected by the shift sensor. Accordingly, even when shift-in is performed before the rotation speed of the engine becomes the first rotation speed or less (in the irregular case), the control to reduce the rotation speed of the engine by the regeneration of the generator is stopped using the shift-in as a trigger. Consequently, the regeneration is continued after the shift-in such that stopping of the engine is significantly reduced or prevented.

In an outboard motor including the generator to drive the engine by power running, the controller is preferably configured or programmed to stop a control to increase the rotation speed of the engine by the power running of the generator based on the rotation speed sensor detecting that the rotation speed of the engine has become a second rotation speed or higher, and perform a control to cause the engine to perform a self-sustaining operation. Accordingly, when the rotation speed of the engine becomes equal to or higher than the second rotation speed, the control to increase the rotation speed of the engine by the power running of the generator is stopped, and thus even when the power running is stopped, the control to increase the rotation speed of the engine by the power running is stopped at the appropriate timing at which the engine is caused to perform a self-sustaining operation.

In such a case, the second rotation speed is preferably about 500 rpm or more, for example. Accordingly, when the rotation speed of the engine becomes equal to or higher than about 500 rpm or more at which the certainty of causing the engine to perform a self-sustaining operation is increased, the control to increase the rotation speed of the engine by the power running is stopped.

In an outboard motor according to a preferred embodiment of the present invention, the controller is preferably configured or programmed to receive a non-neutral signal instead of a neutral signal from the shift operator when the switching operation to switch the outboard motor from the neutral state to the non-neutral state is performed on the shift operator, and perform, during a period of time from a time at which the controller receives the non-neutral signal instead of the neutral signal to a time at which the clutch is connected to the driving force transmitter and switches the outboard motor to the non-neutral state, a control to reduce the rotation speed of the engine by the regeneration of the generator and then connect the clutch to the driving force transmitter while rotating the engine. Accordingly, using a period of time from reception of the non-neutral signal instead of the neutral signal from the shift operator to actual shift-in (a time lag from the switching operation on the shift operator to the actual shift-in), the rotation speed of the engine is effectively reduced.

In an outboard motor including the generator to drive the engine by power running, the generator includes a flywheel magnet or an alternator provided on the engine. Accordingly, one of the flywheel magnet and the alternator reduces the rotation speed of the engine by regeneration to reduce the shift shocks at the time of shift-in. Furthermore, one of the flywheel magnet and the alternator increases the rotation speed of the engine by power running to significantly reduce or prevent engine stall (stopping of the engine) until shift-in and cause the engine to perform a self-sustaining operation after the shift-in.

In an outboard motor according to a preferred embodiment of the present invention, the shift operator preferably includes an operation lever to be moved to a neutral position and a non-neutral position by the user's switching operation, and a lever position sensor to detect a position of the operation lever, and the controller is preferably configured or programmed to perform a control to reduce the rotation speed of the engine by the regeneration of the generator based on the lever position sensor detecting that the operation lever has moved from the neutral position to the non-neutral position, and then connect the clutch to the driving force transmitter while rotating the engine. Accordingly, the lever position sensor accurately detects the neutral position and the non-neutral position of the operation lever, and thus the controller starts the control to reduce the rotation speed of the engine at the more appropriate timing.

In an outboard motor according to a preferred embodiment of the present invention, the controller is preferably configured or programmed to perform a control to reduce the rotation speed of the engine by retarding an ignition timing of the engine as compared with that during steady operation in which the engine performs a self-sustaining operation or stopping ignition of the engine in addition to the regeneration of the generator. Accordingly, as compared with a case in which the rotation speed of the engine is reduced only by the regeneration by the generator, the rotation speed of the engine is more effectively reduced.

In such a case, an outboard motor according to a preferred embodiment of the present invention preferably further includes a capacitor to supply, to the generator to drive the engine by the power running in addition to the regeneration, power to start the engine, and the capacitor is preferably charged by the regeneration of the generator. Accordingly, the capacitor that starts the engine is charged by the regeneration, and thus power generated by the regeneration is effectively used.

In an outboard motor according to a preferred embodiment of the present invention, the non-neutral state preferably includes a forward movement state and a reverse movement state, the driving force transmitter preferably includes a drive shaft, a drive gear provided on the drive shaft, a forward gear to be rotated in a predetermined direction by the drive gear, and a reverse gear to be rotated by the drive gear in a direction opposite to the predetermined direction, the clutch is preferably connected to the forward gear such that the outboard motor runs in the forward movement state, and the clutch is preferably connected to the reverse gear such that the outboard motor runs in the reverse movement state. Accordingly, the rotation speed of the engine is effectively reduced to reduce the shift shocks that occur at the time of shift-in at which the clutch meshes with the forward gear or the reverse gear.

A marine propulsion system according to a preferred embodiment of the present invention includes an outboard motor installed on a hull, and a shift operator provided in the hull. The outboard motor includes an engine including a crankshaft, a generator connected to the crankshaft to generate power by driving of the engine, a driving force transmitter connected to the crankshaft to transmit a driving force from the engine, a propeller shaft including a clutch and to rotate by being switched from a neutral state in which the clutch is disconnected from the driving force transmitter of the engine at idle to a non-neutral state in which the clutch is connected to the driving force transmitter, and a controller configured or programmed to perform a control to reduce a rotation speed of the engine by regeneration of the generator based on a user's switching operation being performed on the shift operator to switch the outboard motor from the neutral state to the non-neutral state, and a non-neutral signal from the shift operator indicating that the outboard motor is in the non-neutral state due to the clutch instead of a neutral signal from the shift operator indicating that the outboard motor is in the neutral state due to the clutch, and then connect the clutch to the driving force transmitter while rotating the engine.

A marine propulsion system according to a preferred embodiment of the present invention includes the controller configured or programmed to perform a control to reduce the rotation speed of the engine by the regeneration of the generator based on the user's switching operation on the shift operator to switch the outboard motor from the neutral state to the non-neutral state, and then connect the clutch to the driving force transmitter while rotating the engine. Accordingly, unlike a conventional case in which a retarding control or misfire control is performed, a brake is directly applied to the crankshaft by the generation of the generator, and thus the rotation speed of the engine is effectively reduced. Therefore, the rotation speed of the engine is effectively reduced at the time of shift-in in order to reduce shift shocks. Furthermore, the rotation speed of the engine is reduced in a shorter time as compared with the conventional case in which a retarding control or misfire control is performed.

A marine propulsion system according to a preferred embodiment of the present invention preferably further includes a rotation speed sensor to detect the rotation speed of the engine, and the controller is preferably configured or programmed to stop the control to reduce the rotation speed of the engine by the regeneration of the generator based on the rotation speed sensor detecting that the rotation speed of the engine has become equal to or lower than a first rotation speed. Accordingly, when the rotation speed of the engine becomes equal to or lower than the first rotation speed, the control to reduce the rotation speed of the engine by the regeneration of the generator is stopped, and thus stopping of the engine (occurrence of engine stall) due to an excessive reduction in the rotation speed of the engine is significantly reduced or prevented.

In a marine propulsion system according to a preferred embodiment of the present invention, the generator preferably drives the engine by power running in addition to regeneration, and the controller is preferably configured or programmed to perform a control to maintain the rotation speed of the engine at the first rotation speed or higher by the power running of the generator until the outboard motor is switched from the neutral state to the non-neutral state by the clutch based on the rotation speed sensor detecting that the rotation speed of the engine has become equal to or lower than the first rotation speed. Accordingly, the power running is performed from the time at which the rotation speed of the engine becomes equal to or lower than the first rotation speed to the shift-in (the time at which the outboard motor is switched from the neutral state to the non-neutral state by the clutch), and thus the shift shocks are reduced by maintaining the rotation speed of the engine relatively low while stopping of the engine due to an excessive reduction in the rotation speed of the engine is significantly reduced or prevented.

A marine propulsion system according to a preferred embodiment of the present invention preferably further includes a shift sensor to detect a shift position of the clutch, and the controller is preferably configured or programmed to perform a control to increase the rotation speed of the engine by the power running of the generator when it is determined that the outboard motor has been switched from the neutral state to the non-neutral state based on the shift position of the clutch detected by the shift sensor. Accordingly, even when rotational resistance is applied from the propeller shaft to the engine via the driving force transmitter after shift-in, the rotation speed of the engine is increased by the power running, and thus stopping of the engine due to shift-in is significantly reduced or prevented.

In a marine propulsion system according to a preferred embodiment of the present invention, the controller is preferably configured or programmed to stop the control to reduce the rotation speed of the engine by the regeneration of the generator when the regeneration of the generator continues and the controller determines that the outboard motor has been switched from the neutral state to the non-neutral state based on the shift position of the clutch detected by the shift sensor. Accordingly, even when shift-in is performed before the rotation speed of the engine becomes the first rotation speed or less (in the irregular case), the control to reduce the rotation speed of the engine by the regeneration of the generator is stopped, using the shift-in as a trigger. Consequently, the regeneration is continued after the shift-in such that stopping of the engine is significantly reduced or prevented.

In a marine propulsion system according to a preferred embodiment of the present invention, the controller is preferably configured or programmed to stop a control to increase the rotation speed of the engine by the power running of the generator based on the rotation speed sensor detecting that the rotation speed of the engine has become a second rotation speed or higher, and perform a control to cause the engine to perform a self-sustaining operation. Accordingly, when the rotation speed of the engine becomes equal to or higher than the second rotation speed, the control to increase the rotation speed of the engine by the power running of the generator is stopped, and thus even when the power running is stopped, the control to increase the rotation speed of the engine by the power running is stopped at the appropriate timing at which the engine is caused to perform a self-sustaining operation.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine propulsion system 100 including an outboard motor 101 according to preferred embodiments of the present invention is now described with reference to FIGS. 1 to 8. In the figures, arrow FWD represents the forward movement direction of a hull B, and arrow BWD represents the reverse movement direction of the hull B.

Figure 1:
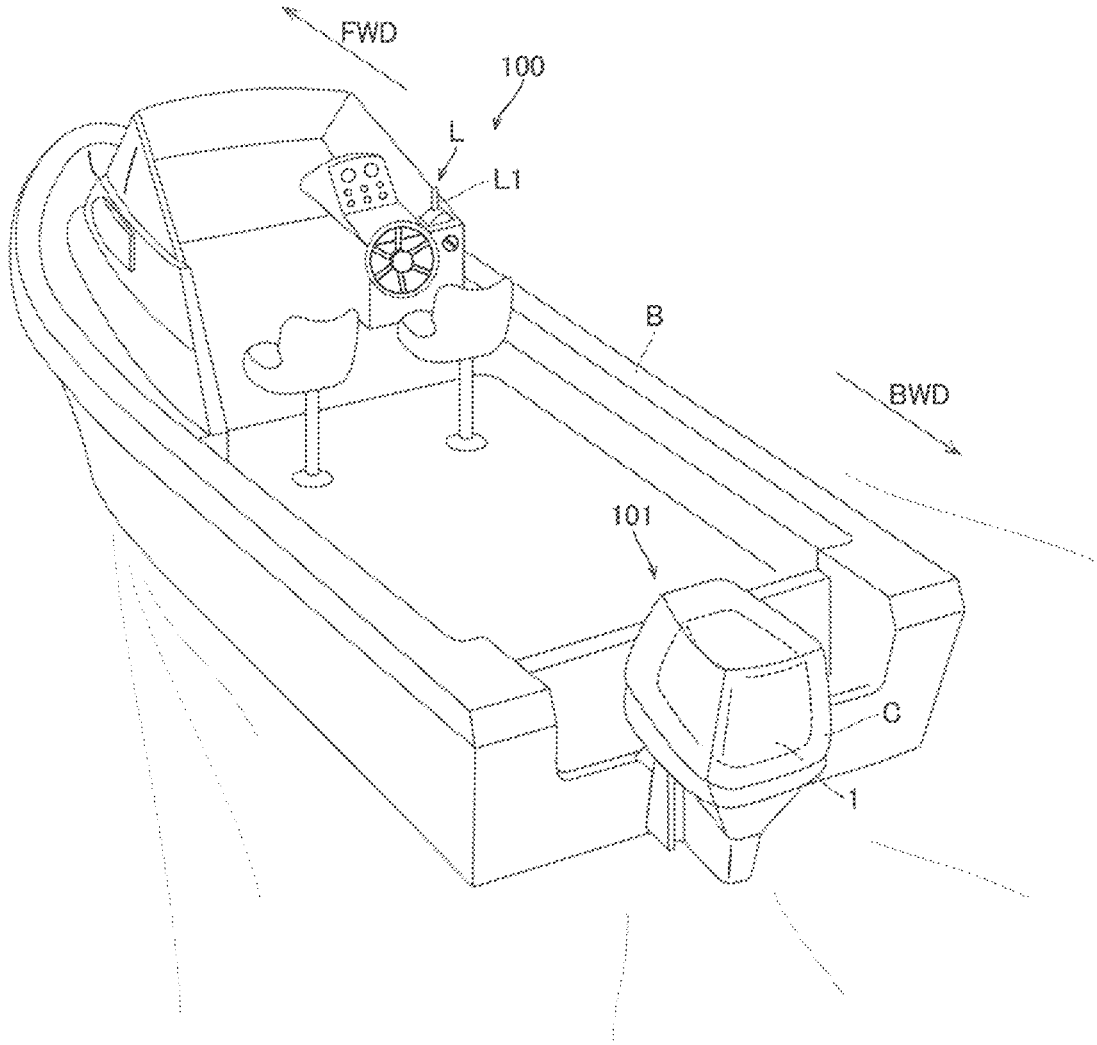
FIG. 1 is a perspective view showing a marine propulsion unit including an outboard motor according to a preferred embodiment of the present invention.
Figure 2:
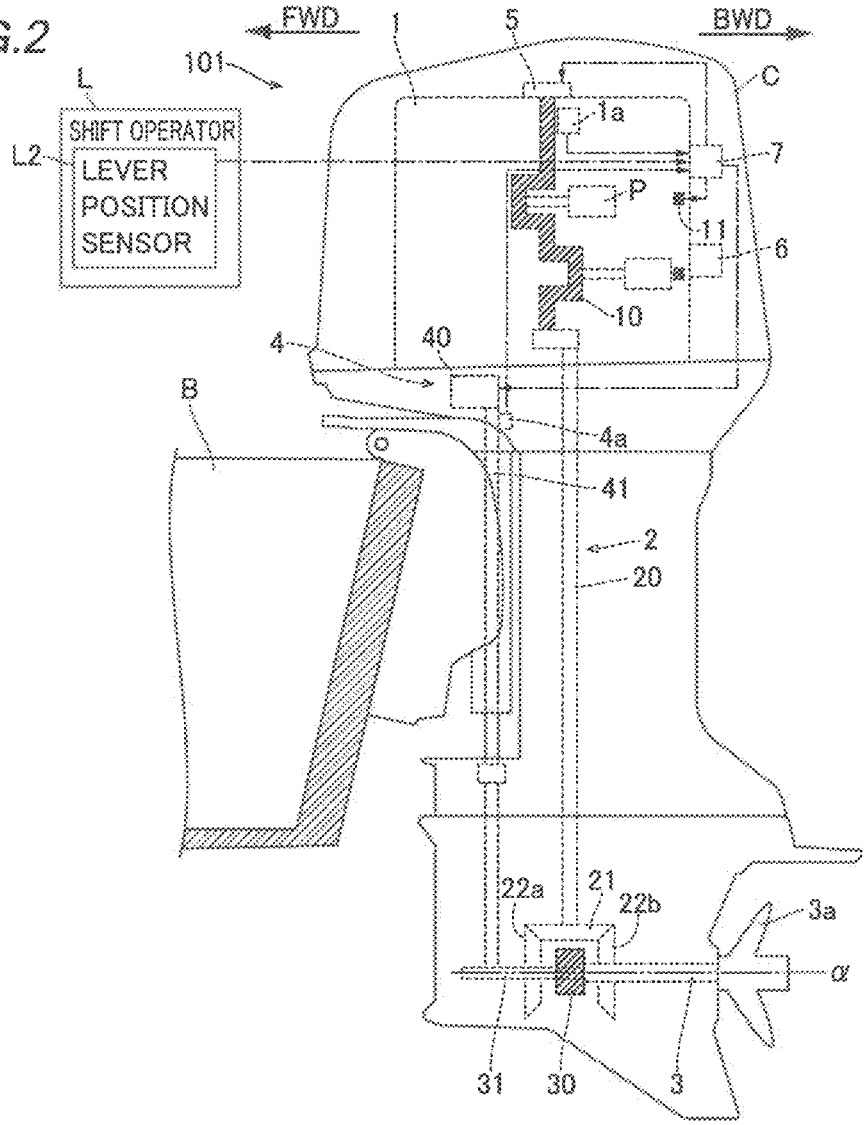
FIG. 2 is a side view illustrating the structure of an outboard motor according to a preferred embodiment of the present invention.

As shown in FIGS. 1 and 2, the marine propulsion system 100 is provided on the hull B. The marine propulsion system 100 includes a shift operator L provided on the hull B and the outboard motor 101 installed at the stern (transom) of the hull B.

The outboard motor 101 (controller 7) according to preferred embodiments of the present invention reduces the rotation speed of an engine 1 by regeneration of a generator 5 based on a user's switching operation on the shift operator L to switch the outboard motor 101 from a neutral state to a forward movement state or a reverse movement state, and then connects a clutch 30 to a driving force transmitter 2 while rotating the engine 1.

In short, when shift-in is performed, the outboard motor 101 reduces the rotation speed of the engine 1 in advance by regeneration such that the rotation speed of the engine 1 is closer to the rotation speeds (0 rpm) of a stopped propeller shaft 3 and the stopped clutch 30. Consequently, the outboard motor 101 reduces shift shocks.

Figure 5:
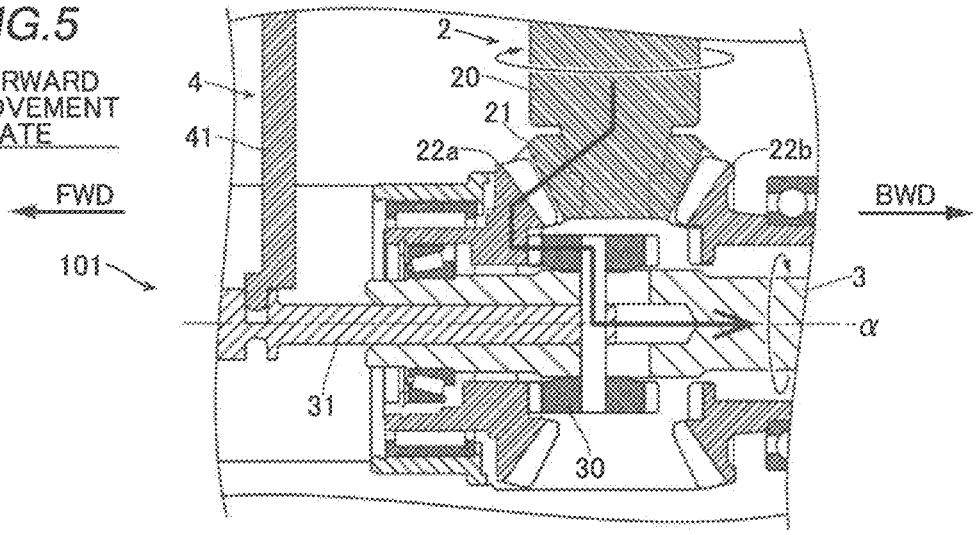
FIG. 5 is a diagram showing the forward movement state of an outboard motor according to a preferred embodiment of the present invention.
Figure 6:
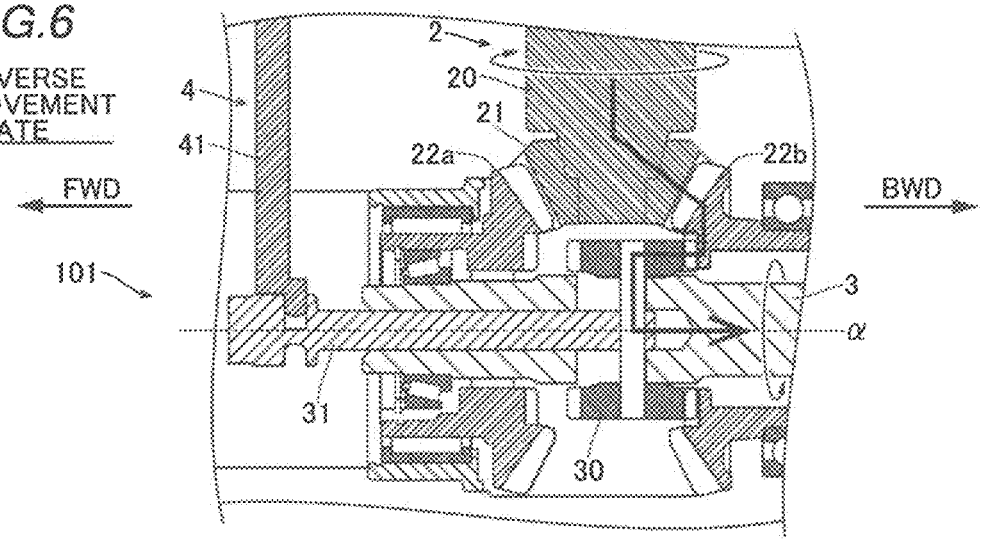
FIG. 6 is a diagram showing the reverse movement state of an outboard motor according to a preferred embodiment of the present invention.

The shift operator L moves the clutch 30 provided on the propeller shaft 3 based on the user's switching operation, and transmits, to the controller 7, signals (a neutral signal, a forward movement signal, and a reverse movement signal) to switch the neutral state (see FIG. 4), the forward movement state (see FIG. 5), and the reverse movement state (see FIG. 6). The forward movement signal and the reverse movement signal are examples of a "non-neutral signal".

Figure 3:
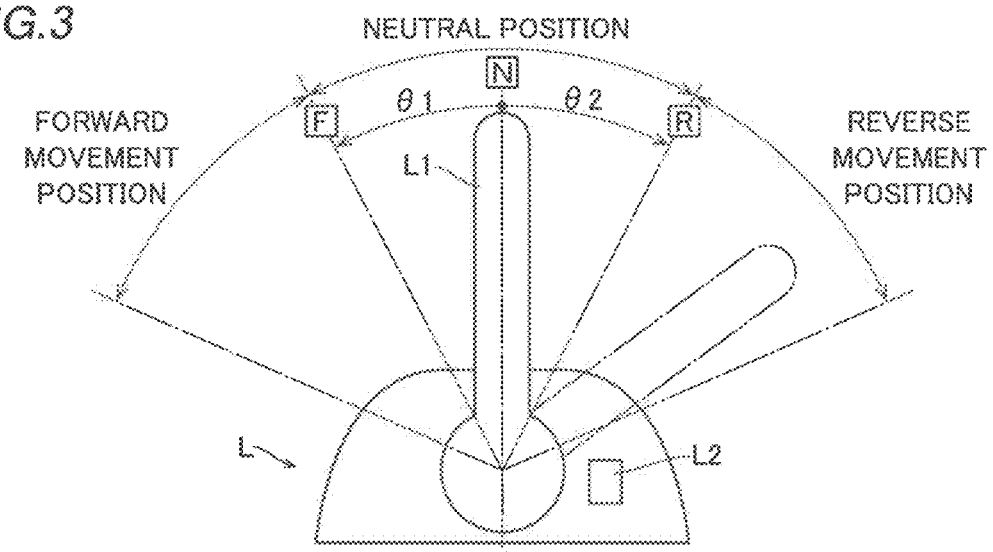
FIG. 3 is a diagram showing a shift operator of a marine propulsion unit according to a preferred embodiment of the present invention.

As shown in FIG. 3, the shift operator L includes an operation lever L1 that is moved (tilted) to any of a neutral position, a forward movement position, and a reverse movement position by the user's switching operation, and a lever position sensor L2 to detect the position of the operation lever L1.

The operation lever L1 is a rod-shaped member gripped by the user, and the lower end thereof is connected to a main body of the shift operator L. The operation lever L1 is tiltable around a central axis located at a lower portion thereof from a reference position that extends upward. As an example, it is assumed that the operation lever L1 is tiltable in a right-left direction. When the operation lever L1 is located at the reference position, the outboard motor 101 is in the neutral state.

The lever position sensor L2 detects the position of the operation lever L1. Specifically, the lever position sensor L2 detects the tilt angle (position) of the operation lever L1. The amount of change in the tilt angle of the operation lever L1 is linked to the amount of movement of the clutch 30 (see FIG. 2).

When the operation lever L1 is tilted to the left by θ1 degrees, the outboard motor 101 is switched from the neutral state to the forward movement state. When the operation lever L1 is tilted to the left and the tilt angle reaches θ1 degrees (at the moment of tilting), a forward movement signal is transmitted from the shift operator L to the controller 7 (see FIG. 2) of the outboard motor 101 (see FIG. 2) instead of a neutral signal.

When the operation lever L1 is tilted to the right by θ2 degrees, the outboard motor 101 is switched from the neutral state to the reverse movement state. When the operation lever L1 is tilted to the right and the tilt angle reaches θ2 degrees (at the moment of tilting), a reverse movement signal is transmitted from the shift operator L to the controller 7 of the outboard motor 101 instead of a neutral signal.

The neutral signal refers to a signal instructing the controller 7 to perform a control to maintain the outboard motor 101 in the neutral state. The forward movement signal refers to a signal instructing the controller 7 to perform a control to maintain the outboard motor 101 in the forward movement state. The reverse movement signal refers to a signal instructing the controller 7 to perform a control to maintain the outboard motor 101 in the reverse movement state.

The shift operator L includes a mode in which a neutral signal, a forward movement signal, and a reverse movement signal are transmitted to the controller 7 as unique signals different from each other, a mode in which a neutral signal, a forward movement signal, and a reverse movement signal are transmitted to the controller 7 as the operation amount (tilt angle amount) of the operation lever L1 detected by the lever position sensor L2.

When the tilt angle of the operation lever L1 is in a range between θ1 degrees on the left side and θ2 degrees on the right side, the operation lever L1 is located at the neutral position. When the tilt angle of the operation lever L1 is in a range of θ1 degrees or more on the left side, the operation lever L1 is located at the forward movement position. When the tilt angle of the operation lever L1 is in a range of θ2 degrees or more on the right side, the operation lever L1 is located at the reverse movement position. As the tilt angle of the operation lever L1 increases, the opening degree of the throttle increases.

Figure 7:
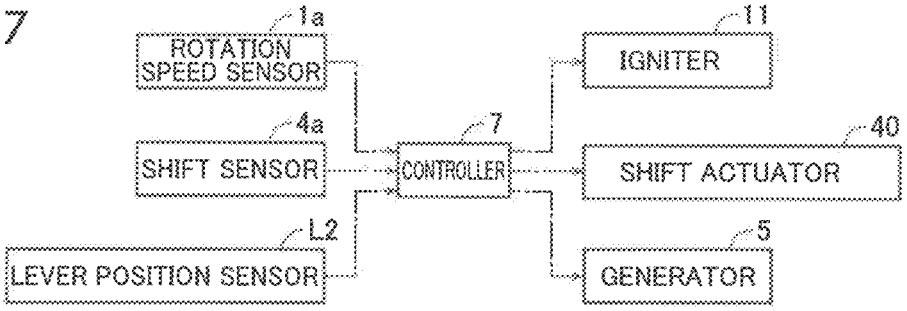
FIG. 7 is a block diagram of structures around a controller of an outboard motor according to a preferred embodiment of the present invention.

As shown in FIGS. 2 and 7, the outboard motor 101 includes the engine 1 including a crankshaft 10 and an igniter 11, a rotation speed sensor 1*a*, the driving force transmitter 2, the propeller shaft 3 including a propeller 3*a*, and a shift device 4, a shift sensor 4*a*, the generator 5, a capacitor 6, and the controller 7.

The engine 1 generates a torque to drive the propeller 3*a*. Specifically, the engine 1 is an internal combustion engine driven by explosive combustion of fuel in a combustion chamber. The engine 1 reciprocates a piston P in a cylinder (not shown) by explosive combustion of fuel to rotate the crankshaft 10. The engine 1 is provided in a cowling C located at the uppermost portion of the outboard motor 101.

The igniter 11 ignites fuel mixed with gas in order to explode and combust the fuel. The ignition timing of the igniter 11 is controlled by the controller 7.

The rotation speed sensor 1*a* detects the rotation speed of the engine 1. The rotation speed of the engine 1 detected by the rotation speed sensor 1*a* is acquired by the controller 7.

The driving force transmitter 2 transmits a driving force from the engine 1 to the propeller shaft 3 via the clutch 30. When the outboard motor 101 is in the forward movement state or the reverse movement state, the driving force (torque) is transmitted from the crankshaft 10 of the engine 1 to a drive shaft 20, a drive gear 21, one of a forward gear 22*a* and a reverse gear 22*b*, the clutch 30, and the propeller shaft 3 in this order, and the propeller 3*a* is rotated. The details are described below.

Figure 4:
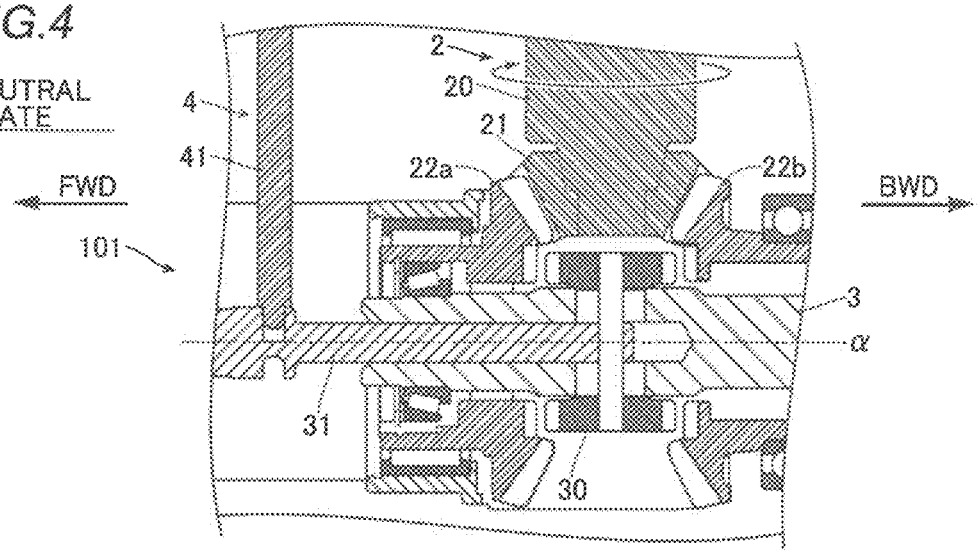
FIG. 4 is a diagram showing the neutral state of an outboard motor according to a preferred embodiment of the present invention.

As shown in FIGS. 4 to 6, the driving force transmitter 2 includes the drive shaft 20, the drive gear 21, the forward gear 22*a*, and the reverse gear 22*b*.

The drive shaft 20 extends in an upward-downward direction, and an upper portion thereof is connected to the crankshaft 10 such that the driving force is transmitted thereto from the crankshaft 10. The drive gear 21 is provided (fixed) at a lower portion of the drive shaft 20. The drive gear 21 is positioned between the forward gear 22*a* positioned on the front side and the reverse gear 22*b* positioned on the rear side in a forward-rearward direction. The drive gear 21 constantly meshes with the forward gear 22*a* and the reverse gear 22*b*.

The drive gear 21, the forward gear 22*a*, and the reverse gear 22*b* are all bevel gears. The forward gear 22*a* and the reverse gear 22*b* each have a ring shape, and the propeller shaft 3 is inserted therethrough. The forward gear 22*a* and the reverse gear 22*b* rotate in opposite directions around a rotation central axis a coaxial with the rotation central axis of the propeller shaft 3.

That is, the forward gear 22*a* is rotated in a predetermined direction around the rotation central axis a by the drive gear 21. The reverse gear 22*b* is rotated by the drive gear 21 in a direction opposite to the rotation direction of the forward gear 22*a*. The driving force transmitter 2 is in a forward movement state in which the clutch 30 is connected to the forward gear 22*a* to rotate the propeller 3*a* in a forward direction, and is in a reverse movement state in which the clutch 30 is connected to the reverse gear 22*b* to rotate the propeller 3*a* in a reverse direction.

The propeller shaft 3 is located below the drive shaft 20. The propeller shaft 3 extends in a horizontal or substantially horizontal direction when the engine 1 (see FIG. 2) is driven.

The propeller shaft 3 includes the clutch 30, and rotates around the rotation central axis a together with the clutch 30 by the driving force from the engine 1. The clutch 30 includes a dog clutch. The clutch 30 is connected to a shift shaft 41 via a connector 31. The clutch 30 is moved in the forward-rearward direction by the shift shaft 41 via the connector 31. The connector 31 is attached to the propeller shaft 3 in a state in which the connector 31 is movable within a predetermined range in the forward-rearward direction with respect to the propeller shaft 3.

The propeller shaft 3 switches from a neutral state in which the clutch 30 is disconnected from the driving force transmitter 2 of the engine 1 at idle to a forward movement state or reverse movement state in which the clutch 30 is connected to the driving force transmitter 2 (one of the forward gear 22*a* and the reverse gear 22*b*) to rotate. Consequently, the propeller 3*a* rotates, and the hull B is propelled.

As shown in FIG. 2, the shift device 4 includes a shift actuator 40 and the shift shaft 41 that extends in the upward-downward direction.

An upper portion of the shift shaft 41 is connected to the shift actuator 40, and a lower portion of the shift shaft 41 is connected to the clutch 30 via the connector 31.

The shift actuator 40 receives a shift switching signal (a neutral signal, a forward movement signal, or a reverse movement signal) from the shift operator L via the controller 7. Then, the shift actuator 40 rotates the shift shaft 41 based on the signal received from the controller 7 to move the clutch 30 together with the connector 31 in the forward-rearward direction. Consequently, the shift actuator 40 switches the outboard motor 101 to any one of three driving states including the neutral state, the forward movement state, and the reverse movement state.

As an example, a slight time lag (about 10 milliseconds to about 100 milliseconds, for example) occurs between the time at which a switching operation is performed on the shift operator L (the time at which the controller 7 determines that the operation lever L1 has switched from the neutral position to the forward movement position or reverse movement position based on a signal received from the shift operator L) and the time at which the clutch 30 actually moves and performs a shift-in operation. The outboard motor 101 (controller 7) performs a control to reduce the shift shocks during this time lag.

The shift sensor 4*a* detects the shift position of the clutch 30.

The "shift position of the clutch 30" is information used by the controller 7 to determine whether the outboard motor 101 is in the neutral state, the forward movement state, or the reverse movement state. The detection results detected by the shift sensor 4*a* are acquired by the controller 7.

The shift sensor 4*a* detects the shift position of the clutch 30 not only by detecting the rotational position of the shift shaft 41, but also by directly detecting the position of the clutch 30 in the forward-rearward direction or by detecting the position of the connector 31 in the forward-rearward direction, for example.

The generator 5 is connected to the crankshaft 10 and generates power by driving of the engine 1. That is, the generator 5 generates power by regeneration as the engine 1 is driven. Therefore, the generator 5 reduces the rotation speed of the engine 1 by regeneration. Driving of the generator 5 is controlled by the controller 7.

The generator 5 includes a flywheel magnet.

The generator 5 is able to drive the engine 1 by power running in addition to regeneration. That is, the generator 5 is able to apply a torque to the engine 1 (crankshaft 10) by power running.

When a retarding control or a misfire control described below is performed on the engine 1, the rotation speed of the engine 1 usually decreases due to rotational resistance (various losses). In such a case, the generator 5 at least maintains the rotation speed of the engine 1 or increases the rotation speed of the engine 1 by power running.

The capacitor 6 supplies, to the generator 5 that is able to drive the engine 1 by power running in addition to regeneration, power to start the engine 1. The capacitor 6 is charged by regeneration of the generator 5. As an example, power running of the generator 5 is performed with at least one of the power of the capacitor 6 or the power of a battery (not shown) in the hull B.

The controller 7 shown in FIG. 7 includes a circuit board including a central processing unit (CPU), a read-only memory (ROM), a random access memory (RAM), etc., for example.

The controller 7 acquires various signals (detection results) from the rotation speed sensor 1*a*, the shift sensor 4*a*, and the lever position sensor L2. The controller 7 controls driving of the igniter 1*b*, the shift actuator 40, and the generator 5 based on the various signals (detection results) from the rotation speed sensor 1*a*, the shift sensor 4*a*, and the lever position sensor L2. The details are described below.

The controller 7 performs various controls to reduce the shift shocks when shift-in is performed (before and after the shift-in including at the time of shift-in) based on the user's switching operation on the shift operator L.

The control of the controller 7 is roughly divided into a "control before shift-in (including at the time of shift-in)" performed until shift-in and a "control after shift-in" performed immediately after shift-in.

The controller 7 receives a forward movement signal (or reverse movement signal) from the shift operator L instead of a neutral signal when a switching operation to switch the outboard motor 101 from the neutral state to the forward movement state (or reverse movement state) is performed on the shift operator L.

Then, the controller 7 shown in FIG. 2 performs, during a period of time from the time at which the controller 7 receives the forward movement signal (or reverse movement signal) instead of the neutral signal from the shift operator L to the time at which the clutch 30 is connected to the driving force transmitter 2 and the outboard motor 101 switches to the forward movement state (or reverse movement state) (the time of shift-in), a control to reduce the rotation speed of the engine 1 by regeneration of the generator 5 and then connect the clutch 30 to the driving force transmitter 2 while rotating the engine 1.

Figure 8:
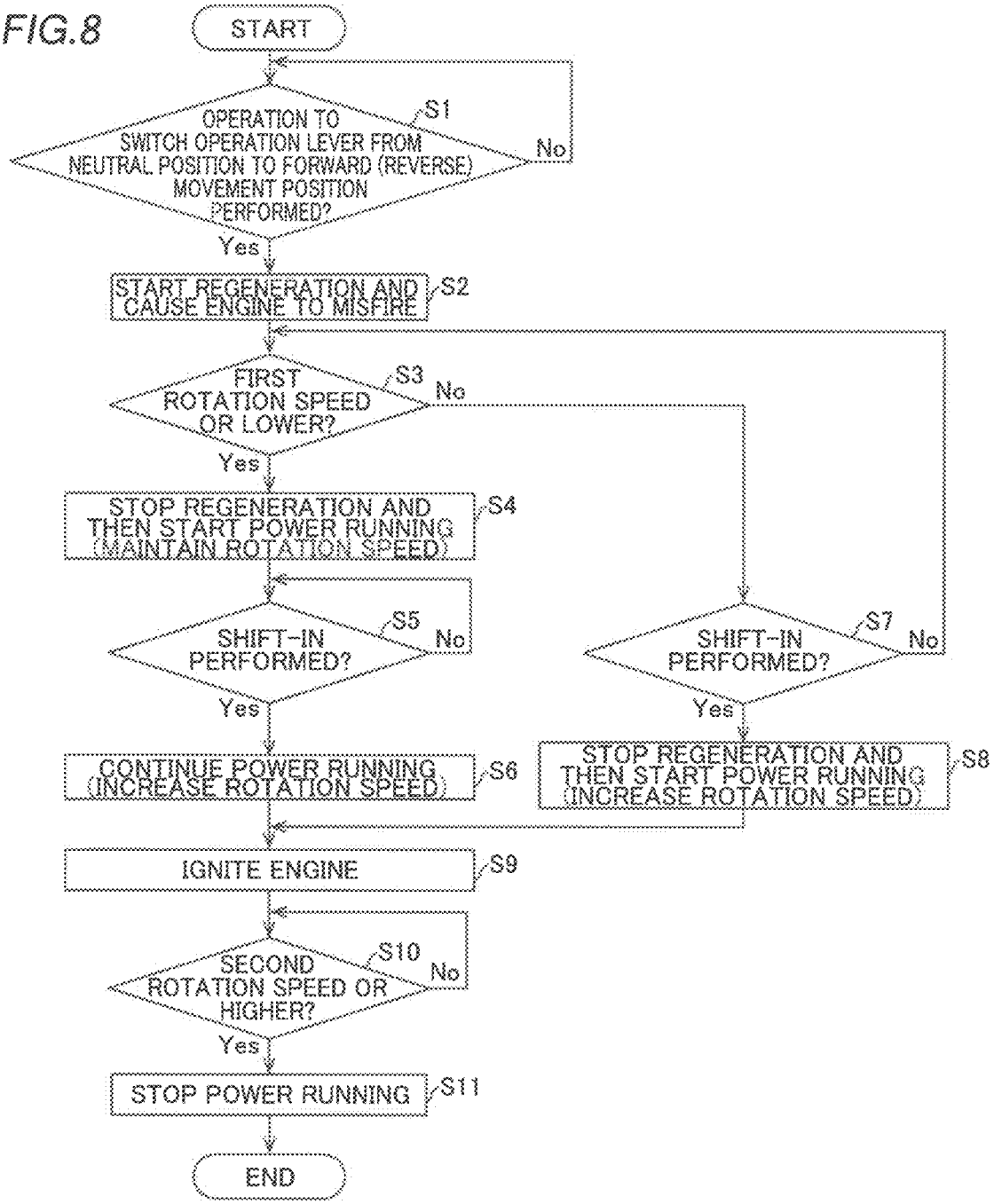
FIG. 8 is a flowchart of a control process performed by a controller to reduce shift shocks according to a preferred embodiment of the present invention.

The "period of time" described above corresponds to a period of time between the time at which "Yes" is determined in step S1 of a control process flow described below and the time at which "Yes" is determined in step S5 (or step S7) of the control process flow (see FIG. 8).

At this time, the controller 7 performs a control to reduce the rotation speed of the engine 1 by regeneration of the generator 5 based on the lever position sensor L2 detecting that the operation lever L1 has moved from the neutral position to the forward movement position (or reverse movement position), and then connect the clutch 30 to the driving force transmitter 2 while rotating the engine 1.

The "based on the lever position sensor L2 detecting that the operation lever L1 has moved from the neutral position to the forward movement position (or reverse movement position)" described above is substantially equivalent to "based on receiving a forward movement signal (or reverse movement signal) from shift operator L instead of a neutral signal".

At this time, the controller 7 performs a control to reduce the rotation speed of the engine 1 by stopping ignition by the igniter 11 of the engine 1 (causing the igniter 11 to misfire) in addition to regeneration of the generator 5. The controller 7 starts a control to stop the ignition of the engine (cause the engine 11 to misfire) at substantially the same timing as the regeneration. The controller 7 stops (terminates) the control to stop the ignition of the engine 1 (cause the engine 11 to misfire) using shift-in as a trigger.

The controller 7 stops a control to reduce the rotation speed of the engine 1 by regeneration of the generator 5 based on the rotation speed sensor 1*a* detecting that the rotation speed of the engine 1 has become equal to or lower than a first rotation speed. As an example, the first rotation speed is a predetermined rotation speed of 300 rpm or less, for example. Preferably, the first rotation speed is a predetermined rotation speed of 100 rpm or less, for example.

Although the shift shocks are further reduced as the rotation speed of the engine 1 is reduced, the possibility that the engine 1 is stopped (engine stall) is increased. Therefore, for the purpose of significantly reducing or preventing stopping of the engine 1, the controller 7 stops regeneration when the rotation speed of the engine 1 becomes equal to or lower than the first rotation speed, as described above.

Furthermore, for the purpose of significantly reducing or preventing stopping of the engine 1, the controller 7 performs a control to maintain the rotation speed of the engine 1 at the first rotation speed or higher by power running of the generator 5 until the outboard motor 101 is switched from the neutral state to the forward movement state (or reverse movement state) by the clutch 30 (until shift-in) based on the rotation speed sensor 1*a* detecting that the rotation speed of the engine 1 has become equal to or lower than the first rotation speed.

When power running is performed, the controller 7 maintains the rotation speed of the engine 1 at a predetermined rotation speed as close to the first rotation speed as possible from the viewpoint of reducing shift shocks. That is, the controller 7 performs a control such that a difference between the rotation speed of the engine 1 and the rotation speeds (0 rpm) of the stopped propeller shaft 3 and clutch 30 does not increase until shift-in.

When it is determined that the outboard motor 101 has been switched from the neutral state to the forward movement state (or reverse movement state) based on the shift position of the clutch 30 detected by the shift sensor 4*a*, the controller 7 performs a control to increase the rotation speed of the engine 1 by power running of the generator 5. That is, it is not necessary to reduce the rotation speed of the engine 1 in order to reduce the shift shocks after shift-in, and thus the controller 7 performs a control to increase the rotation speed of the engine 1 after shift-in.

The controller 7 performs a control to restart the ignition of the engine 1 using shift-in as a trigger.

The controller 7 stops a control to reduce the rotation speed of the engine 1 by regeneration of the generator 5 when regeneration of the generator 5 continues and the controller 7 determines that the outboard motor 101 is switched from the neutral state to the forward movement state (or reverse movement state) based on the shift position of the clutch 30 detected by the shift sensor 4*a* (in the irregular case).

That is, when the rotation speed of the engine 1 is not reduced to the first rotation speed or lower by regeneration by shift-in, the controller 7 performs a control to stop the regeneration using the shift-in as a trigger.

Then, after the shift-in, the controller 7 stops a control to increase the rotation speed of the engine 1 by power running of the generator 5 and performs a control to cause the engine 1 to perform a self-sustaining operation based on the rotation speed sensor 1*a* detecting that the rotation speed of the engine 1 has become equal to or higher than a second rotation speed.

The second rotation speed is higher than the first rotation speed. As an example, the second rotation speed is a predetermined rotation speed of 500 rpm or more, for example. The controller 7 stably shifts the engine 1 to a self-sustaining operation by causing the engine 1 to reach a relatively high rotation speed (second rotation speed or higher) by power running.

A flow of a control process to reduce the shift shocks performed by the controller 7 is now described with reference to FIG. 8. Various controls described below are performed by the controller 7.

First, in step S1, it is determined whether or not the user has performed a switching operation to switch the operation lever L1 from the neutral position to the forward movement position (or reverse movement position) based on the detection results detected by the lever position sensor L2. That is, it is determined whether or not a forward movement signal (or reverse movement signal) has been received from the shift operator L instead of a neutral signal. When it is determined in step S1 that the switching operation to switch the operation lever L1 from the neutral position to the forward movement position (or reverse movement position) has been performed, the process advances to step S2, and when it is determined that the switching operation to switch the operation lever L1 from the neutral position to the forward movement position (reverse movement position) has not been performed, the process operation in step S1 is repeated.

Then, in step S2, regeneration of the generator 5 is started, and ignition by the igniter 11 of the engine 1 is stopped (the engine 1 is caused to misfire). That is, a control to reduce the rotation speed of the engine 1 is started. Then, the process advances to step S3.

Then, in step S3, as a result of regeneration and misfire, it is determined whether or not the rotation speed of the engine 1 detected by the rotation speed sensor 1*a* has reduced to the first rotation speed or lower. When it is determined in step S3 that the rotation speed of the engine 1 has reduced to the first rotation speed or lower, the process advances to step S4, and when it is determined that the rotation speed of the engine 1 has not decreased to the first rotation speed or lower, the process advances to step S7.

Then, in step S4, after regeneration of the generator 5 is stopped, power running of the generator 5 is started to maintain the rotation speed of the engine 1. Then, the process advances to step S5.

Then, in step S5, it is determined whether or not shift-in has been performed based on the detection results detected by the shift sensor 4*a*. That is, it is determined whether or not the clutch 30 has meshed with the forward gear 22*a* (or reverse gear 22*b*). When it is determined in step S5 that the shift-in has been performed, the process advances to step S6, and when it is determined that the shift-in has not been performed, the process operation in step S5 is repeated.

Then, in step S6, power running is performed by the generator 5 to increase the rotation speed of the engine 1. Then, the process advances to step S9.

When the process advances from step S3 to step S7, it is determined in step S7 whether or not the shift-in has been performed based on the detection results detected by the shift sensor 4*a*. That is, it is determined whether or not the clutch 30 has meshed with the forward gear 22*a* (or reverse gear 22*b*). When it is determined in step S7 that the shift-in has been performed, the process advances to step S8, and when it is determined that the shift-in has not been performed, the process returns to step S3.

Note that when shift-in is performed in the process of reducing the rotation speed of the engine 1 (in the irregular case), the process advances from step S7 to step S8. In such a case, the rotation speed of the engine 1 at the time of shift-in is larger than the rotation speed of the engine 1 when the process advances from step S5 to step S6.

Then, in step S8, after regeneration of the generator 5 is stopped, power running of the generator 5 is started to increase the rotation speed of the engine 1. Then, the process advances to step S9.

Then, in step S9, the ignition of the engine 1 is restarted. Then, the process advances to step S10.

Then, in step S10, as a result of power running and ignition, it is determined whether or not the rotation speed of the engine 1 detected by the rotation speed sensor 1*a* has increased to the second rotation speed or higher. When it is determined in step S10 that the rotation speed of the engine 1 has increased to the second rotation speed or higher, the process advances to step S11, and when it is determined that the rotation speed of the engine 1 has not increased to the second rotation speed or higher, the process operation in step S10 is repeated.

Then, in step S11, power running of the generator 5 is stopped, and the engine 1 performs a self-sustaining operation. This completes the controls performed by the controller 7 to reduce the shift shocks.

According to the various preferred embodiments of the present invention described above, the following advantageous effects are achieved.

According to a preferred embodiment of the present invention, the outboard motor 101 includes the controller 7 configured or programmed to perform a control to reduce the rotation speed of the engine 1 by regeneration of the generator 5 based on the user's switching operation on the shift operator L to switch the outboard motor 101 from the neutral state to the non-neutral state (forward or reverse movement state), and then connect the clutch 30 to the driving force transmitter 2 while rotating the engine 1. Accordingly, unlike a conventional case in which a retarding control or misfire control is performed, a brake is directly applied to the crankshaft 10 by regeneration of the generator 5, and thus the rotation speed of the engine 1 is effectively reduced. Therefore, the rotation speed of the engine 1 is effectively reduced at the time of shift-in in order to reduce the shift shocks. Furthermore, the rotation speed of the engine 1 is reduced in a shorter time as compared with the conventional case in which a retarding control or misfire control is performed.

According to a preferred embodiment of the present invention, the outboard motor 101 further includes the rotation speed sensor 1*a* to detect the rotation speed of the engine 1, and the controller 7 is configured or programmed to stop a control to reduce the rotation speed of the engine 1 by regeneration of the generator 5 based on the rotation speed sensor 1*a* detecting that the rotation speed of the engine 1 has become equal to or lower than the first rotation speed. Accordingly, when the rotation speed of the engine 1 becomes equal to or lower than the first rotation speed, the control to reduce the rotation speed of the engine 1 by regeneration of the generator 5 is stopped, and thus stopping of the engine 1 (occurrence of engine stall) due to an excessive reduction in the rotation speed of the engine 1 is significantly reduced or prevented.

According to a preferred embodiment of the present invention, the generator 5 drives the engine 1 by power running in addition to regeneration, and the controller 7 is configured or programmed to perform a control to maintain the rotation speed of the engine 1 at the first rotation speed or higher by power running of the generator 5 until the outboard motor 101 is switched from the neutral state to the non-neutral state (forward or reverse movement state) by the clutch 30 based on the rotation speed sensor 1*a* detecting that the rotation speed of the engine 1 has become equal to or lower than the first rotation speed. Accordingly, the power running is performed from the time at which the rotation speed of the engine 1 becomes equal to or lower than the first rotation speed to the shift-in (the time at which the outboard motor 101 is switched from the neutral state to the non-neutral state by the clutch 30), and thus the shift shocks are reduced by maintaining the rotation speed of the engine 1 relatively low while stopping of the engine 1 due to an excessive reduction in the rotation speed of the engine 1 is significantly reduced or prevented.

According to a preferred embodiment of the present invention, the first rotation speed is a predetermined rotation speed of 300 rpm or less, for example. Accordingly, when the rotation speed of the engine 1 becomes equal to or lower than the predetermined rotation speed of 300 rpm or less at which the possibility that engine stall occurs (the engine 1 is stopped) is increased, a control to reduce the rotation speed of the engine 1 by regeneration is stopped.

According to a preferred embodiment of the present invention, the outboard motor 101 further includes the shift sensor 4*a* to detect the shift position of the clutch 30, and the controller 7 is configured or programmed to perform a control to increase the rotation speed of the engine 1 by power running of the generator 5 when it is determined that the outboard motor 101 has been switched from the neutral state to the non-neutral state (forward or reverse movement state) based on the shift position of the clutch 30 detected by the shift sensor 4*a*. Accordingly, even when rotational resistance is applied from the propeller shaft 3 to the engine 1 via the driving force transmitter 2 after shift-in, the rotation speed of the engine 1 is increased by power running, and thus stopping of the engine 1 due to shift-in is significantly reduced or prevented.

According to a preferred embodiment of the present invention, the controller 7 is configured or programmed to stop a control to reduce the rotation speed of the engine 1 by regeneration of the generator 5 when regeneration of the generator 5 continues and the controller 7 determines that the outboard motor 101 has been switched from the neutral state to the non-neutral state (forward or reverse movement state) based on the shift position of the clutch 30 detected by the shift sensor 4*a*. Accordingly, even when shift-in is performed before the rotation speed of the engine 1 becomes the first rotation speed or less (in the irregular case), a control to reduce the rotation speed of the engine 1 by regeneration of the generator 5 is stopped, using the shift-in as a trigger. Consequently, the regeneration is continued after the shift-in such that stopping of the engine 1 is significantly reduced or prevented.

According to a preferred embodiment of the present invention, the controller 7 is configured or programmed to stop a control to increase the rotation speed of the engine 1 by power running of the generator 5 based on the rotation speed sensor 1*a* detecting that the rotation speed of the engine 1 has become the second rotation speed or higher, and perform a control to cause the engine 1 to perform a self-sustaining operation. Accordingly, when the rotation speed of the engine 1 becomes equal to or higher than the second rotation speed, the control to increase the rotation speed of the engine 1 by power running of the generator 5 is stopped, and thus even when the power running is stopped, the control to increase the rotation speed of the engine 1 by the power running is stopped at the appropriate timing at which the engine 1 is caused to perform a self-sustaining operation.

According to a preferred embodiment of the present invention, the second rotation speed is a predetermined rotation speed of 500 rpm or more, for example. Accordingly, when the rotation speed of the engine 1 becomes equal to or higher than the predetermined rotation speed of 500 rpm or more at which the certainty of causing the engine 1 to perform a self-sustaining operation is increased, a control to increase the rotation speed of the engine 1 by power running is stopped.

According to a preferred embodiment of the present invention, the controller 7 is configured or programmed to receive the non-neutral signal (forward or reverse movement signal) instead of the neutral signal from the shift operator L when the switching operation to switch the outboard motor 101 from the neutral state to the non-neutral state (forward or reverse movement state) is performed on the shift operator L, and perform, during the period of time from the time at which the controller 7 receives the non-neutral signal instead of the neutral signal to the time at which the clutch 30 is connected to the driving force transmitter 2 and the outboard motor 101 is switched to the non-neutral state, a control to reduce the rotation speed of the engine 1 by regeneration of the generator 5 and then connect the clutch 30 to the driving force transmitter 2 while rotating the engine 1. Accordingly, using a period of time from reception of the non-neutral signal instead of the neutral signal from the shift operator L to actual shift-in (a time lag from the switching operation on the shift operator L to the actual shift-in), the rotation speed of the engine 1 is effectively reduced.

According to a preferred embodiment of the present invention, the generator 5 that drives the engine 1 by power running in addition to regeneration includes a flywheel magnet provided on the engine 1. Accordingly, the flywheel magnet reduces the rotation speed of the engine 1 by regeneration to reduce the shift shocks at the time of shift-in. Furthermore, the flywheel magnet increases the rotation speed of the engine 1 by power running to significantly reduce or prevent engine stall (stopping of the engine 1) until shift-in and cause the engine 1 to perform a self-sustaining operation after the shift-in.

According to a preferred embodiment of the present invention, the shift operator L includes the operation lever L1 moved to the neutral position and the non-neutral position (forward or reverse movement position) by the user's switching operation, and the lever position sensor L2 to detect the position of the operation lever L1, and the controller 7 is configured or programmed to perform a control to reduce the rotation speed of the engine 1 by regeneration of the generator 5 based on the lever position sensor L2 detecting that the operation lever L1 has moved from the neutral position to the non-neutral position, and then connect the clutch 30 to the driving force transmitter 2 while rotating the engine 1. Accordingly, the lever position sensor L2 accurately detects the neutral position and the non-neutral position of the operation lever L1, and thus the controller 7 starts the control to reduce the rotation speed of the engine 1 at the more appropriate timing.

According to a preferred embodiment of the present invention, the controller 7 is configured or programmed to perform a control to reduce the rotation speed of the engine 1 by retarding the ignition timing of the engine 1 as compared with that during steady operation in which the engine 1 performs a self-sustaining operation or stopping the ignition of the engine 1 in addition to regeneration of the generator 5. Accordingly, as compared with a case in which the rotation speed of the engine 1 is reduced only by regeneration by the generator 5, the rotation speed of the engine 1 is more effectively reduced.

According to a preferred embodiment of the present invention, the outboard motor 101 further includes the capacitor 6 to supply, to the generator 5 to drive the engine 1 by power running in addition to regeneration, power to start the engine 1, and the capacitor 6 is charged by regeneration of the generator 5. Accordingly, the capacitor 6 that starts the engine 1 is charged by the regeneration, and thus power generated by the regeneration is effectively used.

According to a preferred embodiment of the present invention, the non-neutral state includes the forward movement state and the reverse movement state, the driving force transmitter 2 includes the drive shaft 20, the drive gear 21 provided on the drive shaft 20, the forward gear 22*a* rotated in the predetermined direction by the drive gear 21, and the reverse gear 22*b* rotated by the drive gear 21 in the direction opposite to the rotation direction of the forward gear 22*a*, the clutch 30 is connected to the forward gear 22*a* so as to become the forward movement state, and the clutch 30 is connected to the reverse gear 22*a* so as to become the reverse movement state. Accordingly, the rotation speed of the engine 1 is effectively reduced to reduce the shift shocks that occur at the time of shift-in at which the clutch 30 meshes with the forward gear 22*a* or the reverse gear 22*b*.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the generator preferably includes a flywheel magnet in preferred embodiments described above, the present invention is not restricted to this. In the present invention, the generator may alternatively include a device such as an alternator different from the flywheel magnet.

While both regeneration and power running are preferably performed by the generator in preferred embodiments described above, the present invention is not restricted to this. In the present invention, only regeneration may alternatively be performed by the generator.

While one outboard motor is preferably provided on the hull in preferred embodiments described above, the present invention is not restricted to this. In the present invention, a plurality of outboard motors may alternatively be provided on the hull.

While the rotation speed of the engine is preferably reduced by stopping ignition by the igniter in addition to regeneration of the generator in preferred embodiments described above, the present invention is not restricted to this. In the present invention, the rotation speed of the engine may alternatively be reduced only by regeneration of the generator without stopping ignition by the igniter.

While the rotation speed of the engine is preferably reduced by stopping ignition by the igniter of the engine (causing the engine to misfire) in preferred embodiments described above, the present invention is not restricted to this. In the present invention, the rotation speed of the engine may alternatively be reduced by retarding the ignition timing of the igniter of the engine as compared with that during the steady operation in which the engine performs a self-sustaining operation.

The first rotation speed and the second rotation speed of the engine described in preferred embodiments described above are examples, and the controller may alternatively perform a control to reduce the shift shocks due to the rotation speeds of the engine different from the first rotation speed and the second rotation speed.

While the shift operator is preferably a lever operator including an operation lever in preferred embodiments described above, the present invention is not restricted to this. In the present invention, the shift operator may alternatively be a type of operator such as a button operator different from a lever operator.

While the rotation speed of the engine is preferably maintained by power running of the generator before shift-in in preferred embodiments described above, the present invention is not restricted to this. In the present invention, the rotation speed of the engine may alternatively be increased by power running of the generator before shift-in.

While the process operations performed by the controller are described using a flowchart in a flow-driven manner in which processes are performed in order along a process flow for the convenience of illustration in preferred embodiments described above, the present invention is not restricted to this. In the present invention, the process operations performed by the controller may alternatively be performed in an event-driven manner in which the processes are performed on an event basis. In this case, the process operations performed by the controller may be performed in a complete event-driven manner or in a combination of an event-driven manner and a flow-driven manner.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a crankshaft;

a generator connected to the crankshaft to generate power by driving of the engine;

a driving force transmitter connected to the crankshaft to transmit a driving force from the engine;

a propeller shaft including a clutch and to rotate by being switched from a neutral state in which the clutch is disconnected from the driving force transmitter of the engine at idle to a non-neutral state in which the clutch is connected to the driving force transmitter; and a controller configured or programmed to perform a control to reduce a rotation speed of the engine by regeneration of the generator based on a user's switching operation on a shift operator to switch the outboard motor from the neutral state to a forward movement state as the non-neutral state, and then connect the clutch to the driving force transmitter while rotating the engine; wherein the controller is configured or programmed to stop the control to reduce the rotation speed of the engine by the regeneration of the generator based on the rotation speed of the engine becoming equal to or lower than a first rotation speed before switching from the neutral state to the forward movement state as the non-neutral state.

2. The outboard motor according to claim 1, wherein the generator drives the engine by power running in addition to the regeneration; and the controller is configured or programmed to perform a control to maintain the rotation speed of the engine at the first rotation speed or higher by the power running of the generator until the outboard motor is switched from the neutral state to the non-neutral state by the clutch based on rotation speed of the engine having become equal to or lower than the first rotation speed.

3. The outboard motor according to claim 2, further comprising:

a shift sensor to detect a shift position of the clutch; wherein the controller is configured or programmed to perform a control to increase the rotation speed of the engine by the power running of the generator when it is determined that the outboard motor has been switched from the neutral state to the non-neutral state based on the shift position of the clutch detected by the shift sensor.

4. The outboard motor according to claim 3, wherein the controller is configured or programmed to stop the control to reduce the rotation speed of the engine by the regeneration of the generator when the regeneration of the generator continues and the controller determines that the outboard motor has been switched from the neutral state to the non-neutral state based on the shift position of the clutch detected by the shift sensor.

5. The outboard motor according to claim 2, wherein the controller is configured or programmed to stop a control to increase the rotation speed of the engine by the power running of the generator based on the rotation speed of the engine having become a second rotation speed or higher, and perform a control to cause the engine to perform a self-sustaining operation.

6. The outboard motor according to claim 5, wherein the second rotation speed is 500 rpm or more.

7. The outboard motor according to claim 2, wherein the generator includes a flywheel magnet or an alternator provided on the engine.

8. The outboard motor according to claim 2, further comprising:

a capacitor to supply to the generator power to start the engine; wherein the capacitor is charged by the regeneration of the generator.

9. The outboard motor according to claim 1, wherein the first rotation speed is 300 rpm or less.

10. The outboard motor according to claim 1, wherein the controller is configured or programmed to:

receive a non-neutral signal instead of a neutral signal from the shift operator when the switching operation to switch the outboard motor from the neutral state to the non-neutral state is performed on the shift operator; and perform, during a period of time from a time at which the controller receives the non-neutral signal instead of the neutral signal to a time at which the clutch is connected to the driving force transmitter and switches the outboard motor to the non-neutral state, the control to reduce the rotation speed of the engine by the regeneration of the generator and then connect the clutch to the driving force transmitter while rotating the engine.

11. The outboard motor according to claim 1, wherein the shift operator includes an operation lever to be moved to a neutral position and a non-neutral position by the user's switching operation, and a lever position sensor to detect a position of the operation lever; and the controller is configured or programmed to perform the control to reduce the rotation speed of the engine by the regeneration of the generator based on the lever position sensor detecting that the operation lever has moved from the neutral position to the non-neutral position, and then connect the clutch to the driving force transmitter while rotating the engine.

12. The outboard motor according to claim 1, wherein the controller is configured or programmed to perform a control to reduce the rotation speed of the engine by retarding an ignition timing of the engine as compared with that during steady operation in which the engine performs a self-sustaining operation or stopping ignition of the engine in addition to the regeneration of the generator.

13. The outboard motor according to claim 1, wherein the non-neutral state further includes a reverse movement state;

the driving force transmitter includes a drive shaft, a drive gear provided on the drive shaft, a forward gear to be rotated in a predetermined direction by the drive gear, and a reverse gear to be rotated by the drive gear in a direction opposite to the predetermined direction; and the clutch is connected to the forward gear such that the outboard motor runs in the forward movement state, and the clutch is connected to the reverse gear such that the outboard motor runs in the reverse movement state.

14. A marine propulsion system comprising:

an outboard motor installed on a hull; and a shift operator provided in or on the hull; wherein the outboard motor includes:

an engine including a crankshaft;

a generator connected to the crankshaft to generate power by driving of the engine;

a driving force transmitter connected to the crankshaft to transmit a driving force from the engine;

a propeller shaft including a clutch and to rotate by being switched from a neutral state in which the clutch is disconnected from the driving force transmitter of the engine at idle to a non-neutral state in which the clutch is connected to the driving force transmitter; and a controller configured or programmed to perform a control to reduce a rotation speed of the engine by regeneration of the generator based on a user's switching operation being performed on the shift operator to switch the outboard motor from the neutral state to a forward movement state as the non-neutral state, and a non-neutral signal from the shift operator indicating that the outboard motor is in the non-neutral state due to the clutch instead of a neutral signal from the shift operator indicating that the outboard motor is in the neutral state due to the clutch, and then connect the clutch to the driving force transmitter while rotating the engine; wherein the controller is configured or programmed to stop the control to reduce the rotation speed of the engine by the regeneration of the generator based on the rotation speed of the engine becoming equal to or lower than a first rotation speed before switching from the neutral state to the forward movement state as the non-neutral state.

15. The marine propulsion system according to claim 14, wherein the generator drives the engine by power running in addition to the regeneration; and the controller is configured or programmed to perform a control to maintain the rotation speed of the engine at the first rotation speed or higher by the power running of the generator until the outboard motor is switched from the neutral state to the non-neutral state by the clutch based on the rotation speed of the engine having become equal to or lower than the first rotation speed.

16. The marine propulsion system according to claim 15, further comprising:

a shift sensor to detect a shift position of the clutch; wherein the controller is configured or programmed to perform a control to increase the rotation speed of the engine by the power running of the generator when it is determined that the outboard motor has been switched from the neutral state to the non-neutral state based on the shift position of the clutch detected by the shift sensor.

17. The marine propulsion system according to claim 16, wherein the controller is configured or programmed to stop the control to reduce the rotation speed of the engine by the regeneration of the generator when the regeneration of the generator continues and the controller determines that the outboard motor has been switched from the neutral state to the non-neutral state based on the shift position of the clutch detected by the shift sensor.

18. The marine propulsion system according to claim 15, wherein the controller is configured or programmed to stop a control to increase the rotation speed of the engine by the power running of the generator based on the rotation speed of the engine having become a second rotation speed or higher, and perform a control to cause the engine to perform a self-sustaining operation.

* * * * *